US008783850B2

(12) United States Patent
Stephens et al.

(10) Patent No.: US 8,783,850 B2
(45) Date of Patent: Jul. 22, 2014

(54) DRYING PRINTED MEDIA MOVING ALONG MEDIA PATH

(75) Inventors: David J. Stephens, Springboro, NY (US); Christopher M. Muir, Rochester, NY (US); W. Charles Kasiske, Jr., Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 197 days.

(21) Appl. No.: 13/460,922

(22) Filed: May 1, 2012

(65) Prior Publication Data

US 2013/0293646 A1 Nov. 7, 2013

(51) Int. Cl.

| | |
|---|---|
| ***B41J 2/01*** | (2006.01) |
| ***B41J 11/00*** | (2006.01) |
| *B41M 7/00* | (2006.01) |

(52) U.S. Cl.

CPC ..... *B41J 11/002* (2013.01); *B41J 11/0015* (2013.01); *B41M 7/0072* (2013.01)

USPC ..... 347/102; 347/104; 101/424.1

(58) Field of Classification Search

CPC ..... B41J 11/002; B41J 11/0015; B41J 2/01; B41M 7/0072; C09D 11/101

USPC ..... 347/102, 101, 104; 101/424.1

See application file for complete search history.

(56) References Cited

U.S. PATENT DOCUMENTS

| | | | | |
|---|---|---|---|---|
| 5,568,246 | A * | 10/1996 | Keller et al. | 399/382 |
| 6,731,898 | B1 * | 5/2004 | Landa et al. | 399/298 |
| 7,207,670 | B2 | 4/2007 | Silverbrook et al. | |
| 8,053,044 | B2 | 11/2011 | Zhou et al. | |
| 2007/0242987 | A1 * | 10/2007 | Shida et al. | 399/320 |
| 2009/0189929 | A1 | 7/2009 | Motojima et al. | |
| 2011/0043585 | A1 | 2/2011 | Silverbrook et al. | |
| 2011/0102851 | A1 | 5/2011 | Baeumler | |
| 2011/0199414 | A1 | 8/2011 | Lang | |

FOREIGN PATENT DOCUMENTS

WO WO 2010/097117 9/2010

* cited by examiner

*Primary Examiner* — Manish S Shah
*Assistant Examiner* — Yaovi Ameh
(74) *Attorney, Agent, or Firm* — Christopher J. White; Raymond L. Owens

(57) ABSTRACT

Apparatus for drying media in a printer includes first and second successive printing stations with a first rotatable member that contacts the wet side of the media between them. Each prints on one side of the media. A media-path extender between the first printing station and the first rotatable member includes a dry-side rotatable member and a wet-side rotatable member around which the media path passes in that order. An extension media path is defined from the first printing station past the dry-side member, the wet-side member, and the first rotatable member, in that order, to the second printing station. The printer selectively transports the media either along a bypass media path or along the extension media path. The wet-side member is farther past the first printing station than is the first rotatable member.

10 Claims, 8 Drawing Sheets

DRYING PRINTED MEDIA MOVING ALONG MEDIA PATH

FIELD OF THE INVENTION

This invention pertains to the field of printing and more particularly to drying media moving along a media path.

BACKGROUND OF THE INVENTION

Printers are useful for producing printed images of a wide range of types. Printers print on receivers (or "imaging substrates," "media," or "recording media"), such as pieces or sheets of paper or other planar media, glass, fabric, metal, or other objects. Printers typically operate using subtractive color: a substantially reflective receiver is overcoated image-wise with cyan (C), magenta (M), yellow (Y), black (K), and other colorants. One common type of printer is a printing press that uses inkjet print engines to deposit CMYK inks on a receiver web. A separate marking unit can be used to deposit each color of ink, and the marking units can be arranged in series along the path of the receiver.

The speed of a web-fed inkjet printing press is limited by the drying time of the ink. Between the time an ink drop reaches the media and the time the image side of the media next comes into mechanical contact with a member such as a roller, enough of the solvent in the ink should dry so that ink is not inadvertently transferred to the member. Cut-sheet system, e.g., the HP DESKJET 500C, hold wet paper above the output stack on side guides for a selected dwell time before dropping the sheet on the stack. However, this scheme is not applicable to web presses. Moreover, even in cut sheet presses, it is desirable to maintain a high throughput of pages (large number of pages per minute). Drying time between the printing of one sheet and the printing of the next sheet reduces productivity.

A large number of schemes, e.g., U.S. Pat. No. 8,053,044 to Zhou et al., provide special media that more readily absorb ink or otherwise assist in drying. However, each media type has a certain maximum speed in a given printer. For example, some glossy stock should be printed more slowly than matte stock, since glossy stock does not absorb ink as quickly. It is desirable that customers be as unconstrained as possible in their choice of media, and be able to run media at high print speeds. Moreover, a print shop running both multiple types of presses would prefer not to stock and manage large numbers of different types of media.

Various printers use multiple dryers to dry the web, e.g., the KODAK VERSAMARK DS3700. U.S. Pat. No. 7,207,670 to Silverbrook et al. describes a dryer with an integral media path (col. 29) in which the media hang down in the dryer to form a partial loop while drying. U.S. Patent Publication No. 2011/0199414 by Lang describes idler rollers that contact a second, non-image side of the web until liquid ink on the first, image side of the web has dried or hardened. Moreover, high-thermal-flux drying of clay-coated papers can result in paper blistering when moisture in the paper boils off from under the clay coating. Drying can also heat ink, especially black ink, to a temperature at which the paper around the ink burns off. U.S. Patent Publication No. 2011/0043585 by Silverbrook et al. describes a printer in which distances between print zones, and total length of the media path, are restricted. U.S. Patent Publication No. 2009/0189929 by Motojima et al. describes a zig-zag web path with printheads at each step.

However, these systems still use active dryers. Dryers can require a significant amount of power and floor space. Dryers can damage the paper, as discussed above. Moreover, any drying stage can affect the dimensions of the paper, as described in U.S. Patent Publication No. 2011/0102851. Drying can affect media dimensions unpredictably, since the changes depend on the initial moisture content of the media, the ink laydown and pattern, and the environmental conditions. Dimensional changes can cause mis-registration between images printed sequentially on opposite sides of a web. Moreover, drying between marking units that mark on the same side of the receiver can cause color-to-color mis-registration.

There is a continuing need, therefore, for a way of drying a web with reduced power consumption, reduced footprint requirements, improved registration, and reduced thermal shock of, and damage to, the print media.

Reference is made to WO 201097117, the disclosure of which is incorporated herein by reference.

SUMMARY OF THE INVENTION

According to an aspect of the present invention, there is provided apparatus for drying media having first and second sides and moving along a media path in a printer, comprising:

a) first and second printing stations arranged successively along the media path, adapted to selectively deposit ink on a first selected one of the sides and a second selected one of the sides of the media, respectively;

b) a first rotatable member around which the media path passes, so that the first selected one of the sides of the media contacts the first rotatable member while the media passes from the first printing station to the second printing station, and a bypass media path is defined from the first printing station past the first rotatable member to the second printing station; and c) a media-path extender arranged along the media path between the first printing station and the first rotatable member, the media-path extender including a dry-side rotatable member and a wet-side rotatable member around which the media path passes, the dry-side and the wet-side rotatable members arranged so that the side other than the selected first of the sides contacts the dry-side rotatable member downstream of the first printing station, and the selected first of the sides contacts the wet-side rotatable member downstream of the dry-side rotatable member, so that an extension media path is defined from the first printing station past the dry-side rotatable member, the wet-side rotatable member, and the first rotatable member, in that order, to the second printing station;

d) wherein the printer is adapted to selectively transport the media either along the bypass media path or along the extension media path, and the distance along the extension media path from the first printing station to the wet-side rotatable member is longer than the distance along the bypass media path from the first printing station to the first rotatable member.

An advantage of this invention is that it permits printing using faster speeds over a wider range of substrates. Various embodiments provide additional drying without appreciably increasing power consumption. Various embodiments do not increase the press's footprint. Various embodiments use convection to reduce thermal shock to the media. Various embodiments provide improved registration, both color-to-color and duplex.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

The attached drawings are for purposes of illustration and are not necessarily to scale.

DETAILED DESCRIPTION OF THE INVENTION

The terms "medium," "media," "receiver," "receivers," "recording medium," and "recording media" are used interchangeably herein.

The inkjet (IJ) printing process can be embodied in devices including printers, copiers, scanners, and facsimiles, and analog or digital devices, all of which are referred to herein as "printers." A digital reproduction printing system ("printer") typically includes a digital front-end processor (DFE), a print engine (also referred to in the art as a "marking engine") for applying ink to the receiver, and one or more post-printing finishing system(s) (e.g. a UV coating system, a glosser system, or a laminator system). A printer can reproduce pleasing black-and-white or color onto a receiver. A printer can also produce selected patterns of ink on a receiver, which patterns do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process of jetting ink onto the receiver to form a print image. The finishing system applies features such as protection, glossing, or binding to the prints. The finishing system can be implemented as an integral component of a printer, or as a separate machine through which prints are fed after they are printed. As used herein, "ink" includes liquids that can be jetted but that do not include colorants, e.g., clearcoat protectants or coatings to be applied to receivers.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

Figure 1:
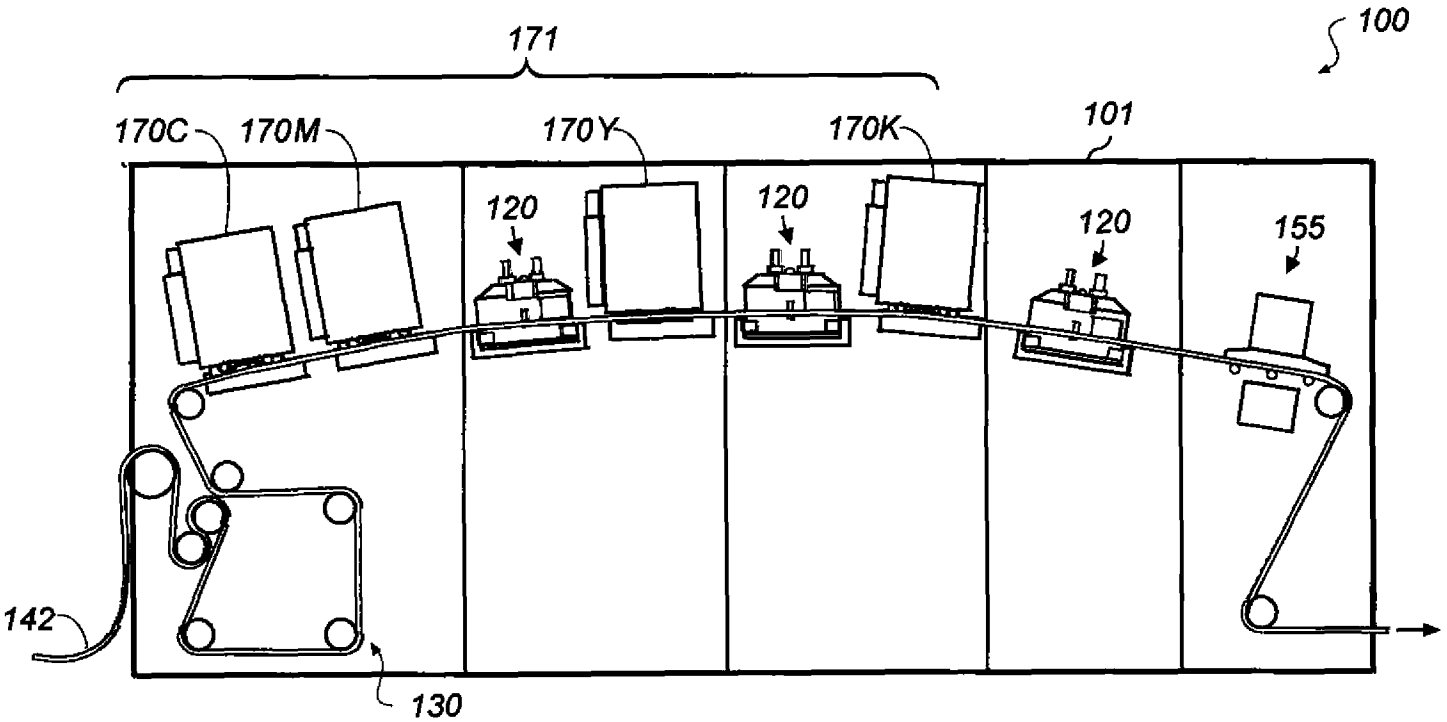
FIG. 1 (PRIOR ART)
FIG. 1 shows a conventional high-speed printer.

FIG. 1 shows a conventional high-speed printer 100 having tower 101. As used herein, a "tower" is a unit with a chassis, a printing station, and supporting components. A tower can print on one side of a receiver. Tower 101 includes printing station 171 and receiver transport system 130. Printing station 171 and receiver transport system 130 cooperate to deposit ink or another donor material on a moving, generally continuous web receiver 142. Receiver 142 is considered a medium and can be paper or another type of media or substrate, e.g., cardboard, cloth or other textiles, plastic or polymer surfaces or substrates (transparent or opaque), glass, metal sheet, multi-layer composite materials, or variations and combinations thereof.

In this example, printer 100 has printing station 171 with four marking units 170C, 170M, 170Y, 170K, although it can have more or fewer. Marking units 170C, 170M, 170Y, and 170K apply cyan, magenta, yellow, and black inks, respectively, to receiver 142. The marking units can apply other colors (including clear or fluorescent), or colors in any order. Dryers 120 positioned after marking units 170M, 170Y, and 170K remove moisture from the applied ink drops and from receiver 142. Camera 155 measures color-to-color registration and stitch. "Stitch" refers to the quality of the mesh between image content printed by different jetting modules within a printhead. The printhead can include a plurality of jetting modules arranged along the cross-track direction, alligned and controlled to produce images without visible discontinuities between data printed by one printhead and data printed by another printhead. A controller (e.g., microcontroller 38 shown in FIG. 2) receives image data from camera 155 and controls marking units 170C, 170M, 170Y, and 170K and receiver transport system 130 to provide desired image quality.

In continuous inkjet printing, a pressurized ink source is used to eject a filament of fluid through a nozzle bore from which ink drops are continually formed using a drop forming device. The ink drops are directed to a desired location using electrostatic deflection, heat deflection, gas-flow deflection, or other deflection techniques. "Deflection" refers to a change in the direction of motion of a given drop. For simplicity, drops will be described herein as either undeflected or deflected. However, "undeflected" drops can be deflected by a certain amount, and "deflected" drops deflected by more than the certain amount. Alternatively, "deflected" and "undeflected" drops can be deflected in opposite directions.

In various embodiments, to print in an area of a recording medium or receiver, undeflected ink drops are permitted to strike the recording medium. To provide unprinted areas of the recording medium, drops which would land in that area if undeflected are instead deflected into an ink capturing mechanism such as a catcher, interceptor, or gutter. These captured drops can be discarded or returned to the ink source for re-use. In other embodiments, deflected ink drops strike the recording medium to print, and undeflected ink drops are collected in the ink capturing mechanism to provide non-printing areas.

Figure 2:
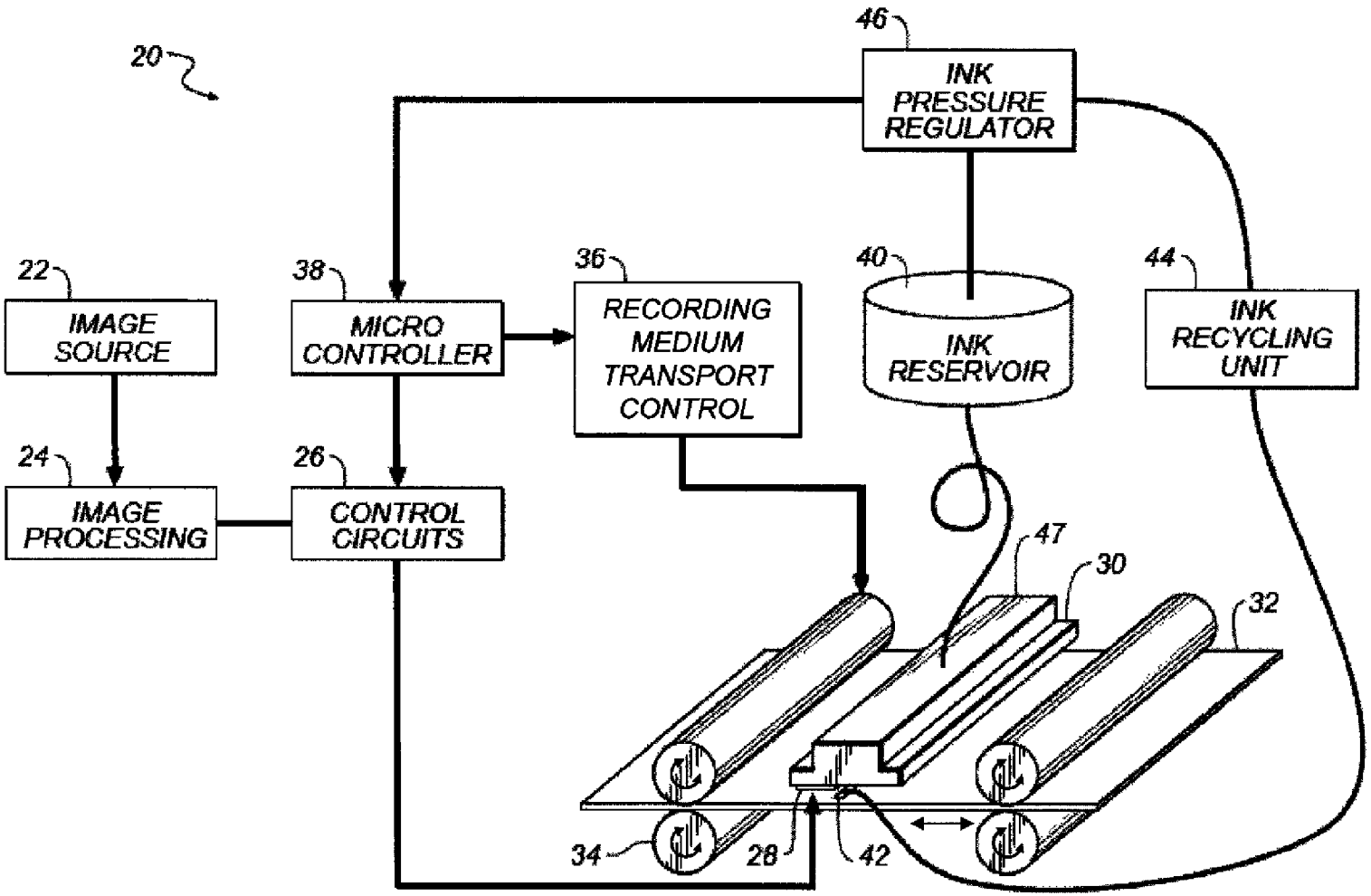
FIG. 2 is a schematic diagram of a continuous-inkjet printing system useful with various embodiments.

FIG. 2 is a schematic diagram of a continuous-inkjet printing system useful with various embodiments. Continuous printing system 20 includes image source 22, e.g., a scanner or computer, that provides raster image data, outline image data in the form of a page description language, or other forms of digital image data. This image data is converted to halftoned bitmap image data and stored in memory by image processing unit 24. A plurality of drop forming mechanism control circuits 26 read data from the image memory and apply time-varying electrical pulses to one or more drop forming device(s) 28, each associated with one or more nozzles of a printhead 30. These pulses are applied at an appropriate time, and to the appropriate nozzle, so that drops formed from a continuous inkjet stream will form spots on a recording medium 32 in the appropriate positions designated by the data in the image memory.

Recording medium 32 is moved relative to printhead 30 by a recording medium transport system 34, which is electronically controlled by a recording medium transport control system 36, which in turn is controlled by a micro-controller 38. Micro-controller 38 controls the timing of control circuits 26 and recording medium transport control system 36 so that drops land at the desired locations on recording medium 32. Micro-controller 38 can be implemented using an MCU, FPGA, PLD, PLA, PAL, CPU, or other digital stored-program or stored-logic control element. The recording medium transport system 34 shown in FIG. 1 is a schematic only, and many different mechanical configurations are possible. For example, a transfer roller can be used in recording medium transport system 34 to facilitate transfer of the ink drops to recording medium 32. With page-width printheads, recording medium 32 can be moved past a stationary printhead. With scanning print systems, the printhead can be moved along one axis (the sub-scanning or fast-scan direction), and the recording medium can be moved along an orthogonal axis (the main scanning or slow-scan direction) in a relative raster motion.

Ink is contained in ink reservoir 40 under pressure. In the non-printing state, continuous inkjet drop streams are not permitted to reach recording medium 32. Instead, they are caught in ink catcher 42, which can return a portion of the ink to ink recycling unit 44. Ink recycling unit 44 reconditions the ink and feeds it back to reservoir 40. Ink recycling units can include filters. A preferred ink pressure for a given printer can be selected based on the geometry and thermal properties of the nozzles and the thermal properties of the ink. Ink pressure regulator 46 controls the pressure of ink applied to ink reservoir 40 to maintain ink pressure within a desired range. Alternatively, ink reservoir 40 can be left unpressurized (gauge pressure approximately zero, so air in ink reservoir 40 is at approximately 1 atm of pressure), or can be placed under a negative gauge pressure (vacuum). In these embodiments, a pump (not shown) delivers ink from ink reservoir 40 under pressure to the printhead 30. Ink pressure regulator 46 can include an ink pump control system.

The ink is distributed to printhead 30 through an ink manifold 47. Ink manifold 47 can include one or more ink channels or ports. Ink flows through slots or holes etched through a silicon substrate of printhead 30 to the front surface of printhead 30, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) that is described in more detail below with reference to FIG. 3.

Figure 3:
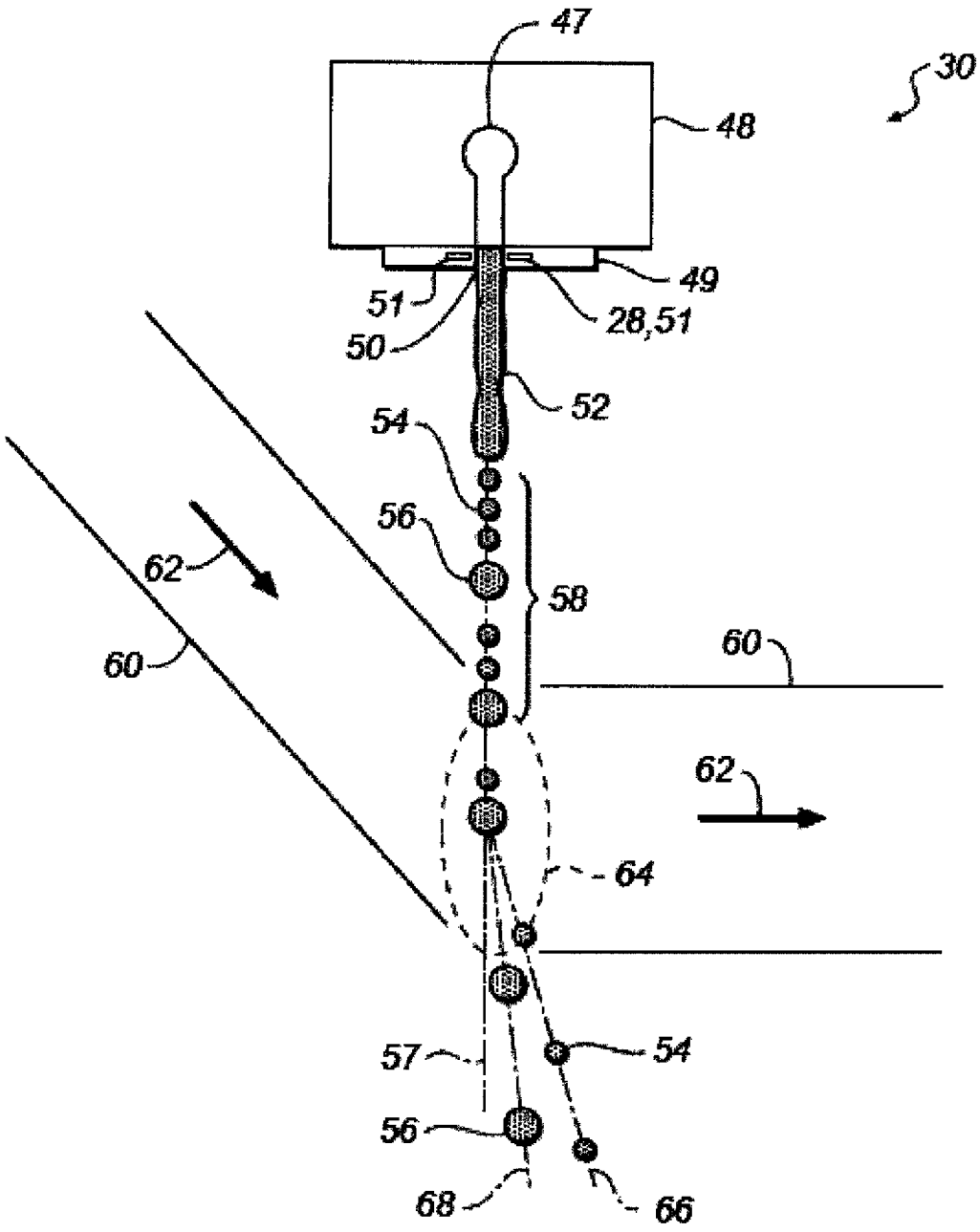
FIG. 3 is an elevational cross-section of a continuous inkjet printhead useful with various embodiments

FIG. 3 is an elevational cross-section of a continuous inkjet printhead 30 useful with various embodiments. A jetting module 48 of printhead 30 includes an array or a plurality of nozzles 50 formed in nozzle plate 49. In FIG. 3, nozzle plate 49 is affixed to jetting module 48. Nozzle plate 49 can also be an integral portion of the jetting module 48.

Liquid, for example, ink, is emitted under pressure through each nozzle 50 of the array to form filaments 52 of liquid. In FIG. 3, the array or plurality of nozzles extends into and out of the plane of the figure.

Jetting module 48 is operable to form, through each nozzle, liquid drops having a first size or volume and liquid drops having a second size or volume different from the first size or volume. The two sizes are referred to as "small" and "large" relative to each other; no limitation of magnitude or difference in magnitude should be inferred from this terminology. Small drops can be either undeflected or deflected, as can large drops. To produce two sizes of drops, jetting module 48 includes a drop stimulation or drop forming device 28, for example, a heater or a piezoelectric actuator. When drop-forming device 28 is selectively activated, it provides energy that perturbs filament 52 of liquid to induce portions of each filament 52 to break off from filament 52 and coalesce to form drops, e.g., small drops 54 or large drops 56.

In FIG. 3, drop forming device 28 is a heater 51, for example, an asymmetric heater or a ring heater (either segmented or not segmented), located in a nozzle plate 49 on one or both sides of nozzle 50. Examples of this type of drop formation are described in, for example, U.S. Pat. No. 6,457,807, issued to Hawkins et al., on Oct. 1, 2002; U.S. Pat. No. 6,491,362, issued to Jeanmaire, on Dec. 10, 2002; U.S. Pat. No. 6,505,921, issued to Chwalek et al., on Jan. 14, 2003; U.S. Pat. No. 6,554,410, issued to Jeanmaire et al., on Apr. 29, 2003; U.S. Pat. No. 6,575,566, issued to Jeanmaire et al., on Jun. 10, 2003; U.S. Pat. No. 6,588,888, issued to Jeanmaire et al., on Jul. 8, 2003; U.S. Pat. No. 6,793,328, issued to Jeanmaire, on Sep. 21, 2004; U.S. Pat. No. 6,827,429, issued to Jeanmaire et al., on Dec. 7, 2004; and U.S. Pat. No. 6,851,796, issued to Jeanmaire et al., on Feb. 8, 2005, the disclosures of all of which are incorporated herein by reference.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a gas flow 62, for example, air, past a portion of the drop trajectory 57. This portion of the drop trajectory is called the deflection zone 64. As the gas flow 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by gas flow 62 than are large drops 56 so that the small drop trajectory 66 diverges from the large drop trajectory 68. That is, the deflection angle for small drops 54 is larger than for large drops 56. The gas flow 62 provides sufficient drop deflection and therefore sufficient divergence of the small and large drop trajectories so that catcher 42 (FIG. 2) can be positioned to intercept one of the small drop trajectory 66 and the large drop trajectory 68 so that drops following the trajectory are collected by catcher 42 while drops following the other trajectory bypass the catcher 42 and impinge a recording medium 32 (shown in FIG. 2).

When catcher 42 is positioned to intercept large drop trajectory 68, small drops 54 are deflected sufficiently to avoid contact with catcher 42 and strike the recording media. As the small drops are printed, this is called small drop print mode. When catcher 42 is positioned to intercept small drop trajectory 66, large drops 56 are the drops that print. This is referred to as large drop print mode.

Various embodiments can use gas flow deflection as described in U.S. Pat. No. 6,588,888 or U.S. Pat. No. 4,068, 241, or electrostatic deflection as described in U.S. Pat. No. 4,636,808, the disclosures of all of which are incorporated herein by reference.

Figure 4:
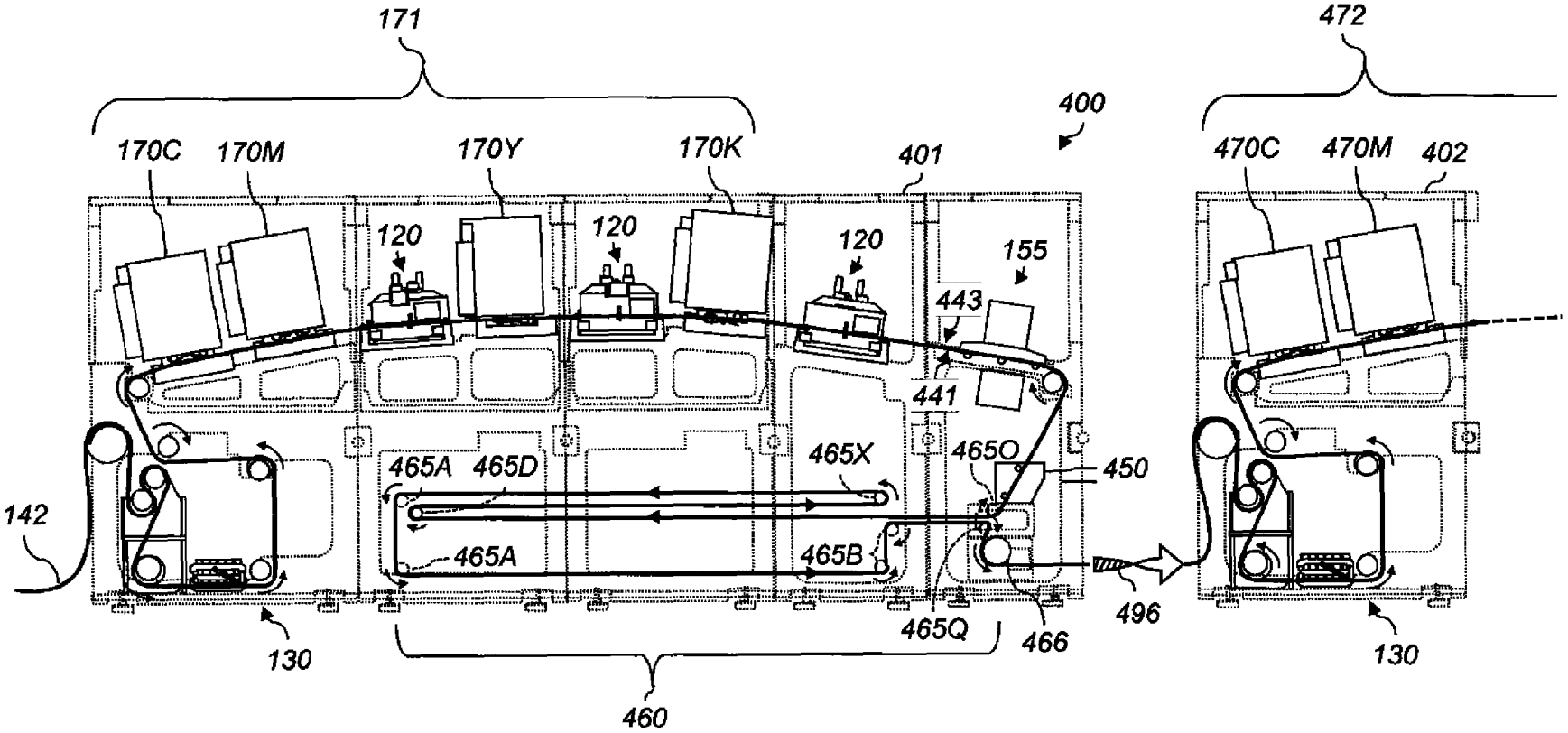
FIG. 4 is an elevational cross-section of a printer according to various embodiments.

FIG. 4 shows printer 400 according to various embodiments. Printer 400 includes tower 401, 402 with inverter 496 between them. For clarity, only part of tower 402 is shown. Printing station 171, marking units 170C, 170Y, 170M, 170K, receiver transport system 130, dryers 120, and camera 155 are as shown in FIG. 1. Marking units 170C, 170Y, 170M, 170K can include continuous inkjet printheads, described above with reference to FIGS. 2 and 3, drop-on-demand inkjet printheads, or other devices for marking receiver 142 in a desired pattern. Tower 402 includes printing station 472 with marking units 470C (cyan) and 470M (magenta), and also marking units for yellow and black (not shown) analogous to marking units 170Y, 170K. Printing stations 171, 472 are arranged successively along the media path, the path along which receiver 142 moves. As used herein, the media path is described to "pass" members around which receiver 142 is entrained at some time while moving, or into contact with which receiver 142 comes at some times while moving.

Scanner 450 and camera 155 measure the position and density of test patches, alignment features, print job content, or other markings on receiver 142. Scanner 450 and camera 155 can include one or more line-scan camera(s) or CMOS or CCD image sensor(s), or combinations thereof. Data from scanner 450 and camera 155 are used (e.g., by micro-controller 38, FIG. 2) to maintain image quality. In various embodiments, scanner 450 measures density to perform color correction, and camera 155 measures color-to-color registration (cross-track and in-track alignment of print images from different marking units 170C, 170M, 170Y, 170K) and stitch, as described above with reference to FIG. 1.

Receiver 142 moves along a media path in printer 400. "Downstream" refers to the direction of motion of receiver 142 along the media path; "upstream" refers to the opposite direction. In various embodiments, the media web is self-supported, i.e., entrained around rotatable members in, but not carried on a belt through, printer 400. In other embodiments, the media is carried through printer 400 or components thereof by a transport web. In other embodiments, a transport web is used in the media path instead of receiver 142. In various embodiments, the media receivers are cut sheets, and printer 400 includes a transport web or one or more rotatable transport members (belts or drums) arranged along the media path to carry the media sheets.

Inverter 496 is represented graphically as a twisted arrow. Receiver 142 has first and second sides. As receiver 142 passes through inverter 496, it is inverted. Therefore, tower 401 deposits ink on a first selected one of the sides of receiver 142 (e.g., the front), and tower 402 deposits ink on a second selected one of the sides of web receiver 142 (e.g., the back). The first and second sides are different when inverter 496 is used. In other embodiments, inverter 496 is not used, so towers 401, 402 print on the same side of receiver 142. Therefore, the first and second selected sides of receiver 142 are the same. In some embodiments, tower 401 deposits CMYK inks, and tower 402 deposits specialty inks on the side bearing the CMYK image. In various embodiments, inverter 496 includes a turn bar, e.g., as used in a KODAK PROSPER press, or a belt inverter, e.g., as used in a KODAK NEXPRESS press.

Receiver 142 has a "wet" side, which is defined herein as the side most recently printed. For extender 460 (discussed below) in tower 401, wet side 443 is the side printed on by marking units 170C, 170M, 170Y, 170K. Receiver 142 also has a "dry" side (dry side 441 in tower 401), which is the side opposite the wet side. The terms "wet" and "dry" do not require any particular moisture content of either side, except that the wet side bears ink that, on average, has a higher moisture content than any ink on the dry side. In embodiments using inverter 496, the wet and dry sides in tower 402 are opposite those of tower 401, so what was wet side 443 in tower 401 is the dry side in tower 402.

The media path passes rotatable member 466, so to exit tower 401 for tower 402, receiver 142 is entrained around rotatable member 466. Wet side 443 contacts rotatable member 466 while (or at least at one point in time during) receiver 142 passes from first printing station 171 to second printing station 472. This defines a "bypass media path" from first printing station 171 past member 466 to second printing station 472. If the moisture content of the ink on wet side 443 is above a threshold when the moist ink comes into contact with member 466, nip offset can occur. Media-path extender 460 is used to reduce the moisture content of the ink before it reaches rotatable member 466 to reduce the probability of offset.

Media-path extender 460 is arranged along the media path between first printing station 171 and rotatable member 466. Extender 460 includes dry-side rotatable member 465O and wet-side rotatable member 465X, around both of which the media path passes. Members 465O, 465X are arranged so that the side other than the selected first of the sides, here dry side 441, contacts dry-side rotatable member 465O downstream of first printing station 171. The selected first of the sides, here wet side 443, contacts wet-side rotatable member 465X downstream of dry-side member 465O. This defines an extension media path from first printing station 171 past dry-side member 465O, wet-side member 465X, rotatable member 465Q, and rotatable member 466, in that order, to second printing station 472.

Printer 400 is adapted to selectively transport receiver 142 either along the bypass media path (not through extender 460) or along the extension media path (through extender 460), and the distance along the extension media path from first printing station 171 (i.e., from the most-downstream point on the media path in printing station 171 at which ink is deposited on receiver 142) to wet-side member 465X is longer than the distance along the bypass media path from first printing station 171 to rotatable member 466. This provides the wet ink more time to dry before it is brought into contact with a member, and thus reduces the probability of offset.

Extender 460 can also include one or more dry-side rotatable members arranged along the media path upstream of wet-side rotatable member 465X. In this example, member 465D is downstream of member 465O and upstream of member 465X. Extender 460 can also include other rotatable members 465A, 465B, 465D, dry-side or wet-side, which the media path passes (around which receiver 142 is entrained). Members 465A, 465B, 465D, 465O, 465X, which can be rollers or belts, are shown dashed for clarity. As discussed above, receiver 142 can be a web or can be one or more cut sheets of media carried on a transport web.

Dryers 120 generally heat receiver 142 to assist in the removal of water or solvents, e.g., those found in the carrier fluid of ink drops. As a result, the temperature of receiver 142 increases as it passes along the media path through printing station 171 and the following dryer 120. In FIG. 1, receiver 142 can be very hot, e.g., nearly 135° C., as it exits tower 101. The temperature of receiver 142 depends on dryer power, web speed, ink coverage on the wet side, and paper type. In embodiments shown in FIG. 4, extender 460 provides receiver 142 additional time to cool after drying. In various embodiments, the media reduces temperature by 20°, or 20°-

30°, between printing station 171 and printing station 472, including during its time in extender 460, as measured by a hand-held optical pyrometer. The reduction in temperature depends on media type, time in extender 460, web velocity, and whether any active cooling is used.

In various embodiments, dryers 120 are operated at a lower temperature or power when used in a printer with extender 460 than they would otherwise be. This can reduce thermal shock to receiver 142, and provide better control over the stretching or shrinking of receiver 142. This can improve both color-to-color registration, by reducing stretch and shrink between marking units 170C, 170M, 170Y, 170K, and front-to-back registration, by reducing the amount of dimensional change in receiver 142 that occurs after printing station 171 (in tower 401) but before printing station 472 (in tower 402).

In various embodiments, extender 460 provides these benefits without increasing the physical footprint of tower 401. In the examples shown here, each tower 401, 402 includes a respective chassis, and extender 460 is disposed under or within the chassis of tower 401. That is, each printing station 171, 472 is associated with a respective chassis, and the extender is disposed under or within the chassis corresponding to printing station 171.

In various embodiments, to facilitate threading a web, at least some of members 465A, 465B, 465D, 465O, 465X are movable. In an example, members 465A, 465D can move to the right and members 465B, 465X can move towards to the left. In various embodiments, the movable members of members 465A, 465D, 465B, 465O, 465X can also move vertically, or in any direction, or in one or more selected directions. Continuing this example, members 465A, 465D move right of members 465B, 465X. An operator places transport web in the lateral gap between members 465B, 465X on the left and members 465A, 465D on the right. Members 465A, 465B, 465D, 465X then move back to their original positions. As they move, they pull receiver 142 (or a transport web) between them into the desired media path.

In various embodiments, at least some of members 465A, 465B, 465D, 465O, 465X are movable. Micro-controller 38 (FIG. 2) or another controller adjusts the position of the members depending on the type of print job, ink laydown, receiver speed (web speed), or operator controls. For low-speed or draft (low-ink-laydown) jobs, the movable members of members 465A, 465B, 465D, 465O, 465X are moved to reduce the length of the media path in extender 460. This reduces waste and initial latency. For jobs that require more drying, e.g., full-color, high-quality jobs, or jobs that require faster drying, such as faster-speed jobs, the movable members of members 465A, 465B, 465D, 465O, 465X are moved to increase the length of the media path in extender 460. The length of the media path in extender 460 does not affect the throughput of the printer (m/s printed), but only affects latency (time from first ink jetting in marking unit 170C, printing station 171 to first sheet out of the printer).

In various embodiments, printer 400 includes extender 460 designed to reduce the moisture content of the deposited ink on receiver 142 while the media passes along the media path from printing station 171 to wet-side member 465X. Reducing the moisture content of receiver 142 can provide reduced condensation. For example, when receiver 142 is hot leaving tower 401, moisture from heated receiver 142 can condense on components of marking unit 170C in tower 402. Reducing the temperature and moisture content of receiver 142 reduces the relative humidity of the air around receiver 142, reducing the localized dew point around, and thus condensation on, cooler surfaces. This can reduce the need for active cooling between towers 401, 402.

The time a given point on receiver 142 requires to travel the media path through extender 460 at a given print speed is referred to herein as the "dwell time" of extender 460 at that speed. The larger the dwell time is, the more opportunity receiver 142 has to dry and cool. Additional drying permits the press operator to choose from a wider range of combinations of media and print speed.

Figure 8:
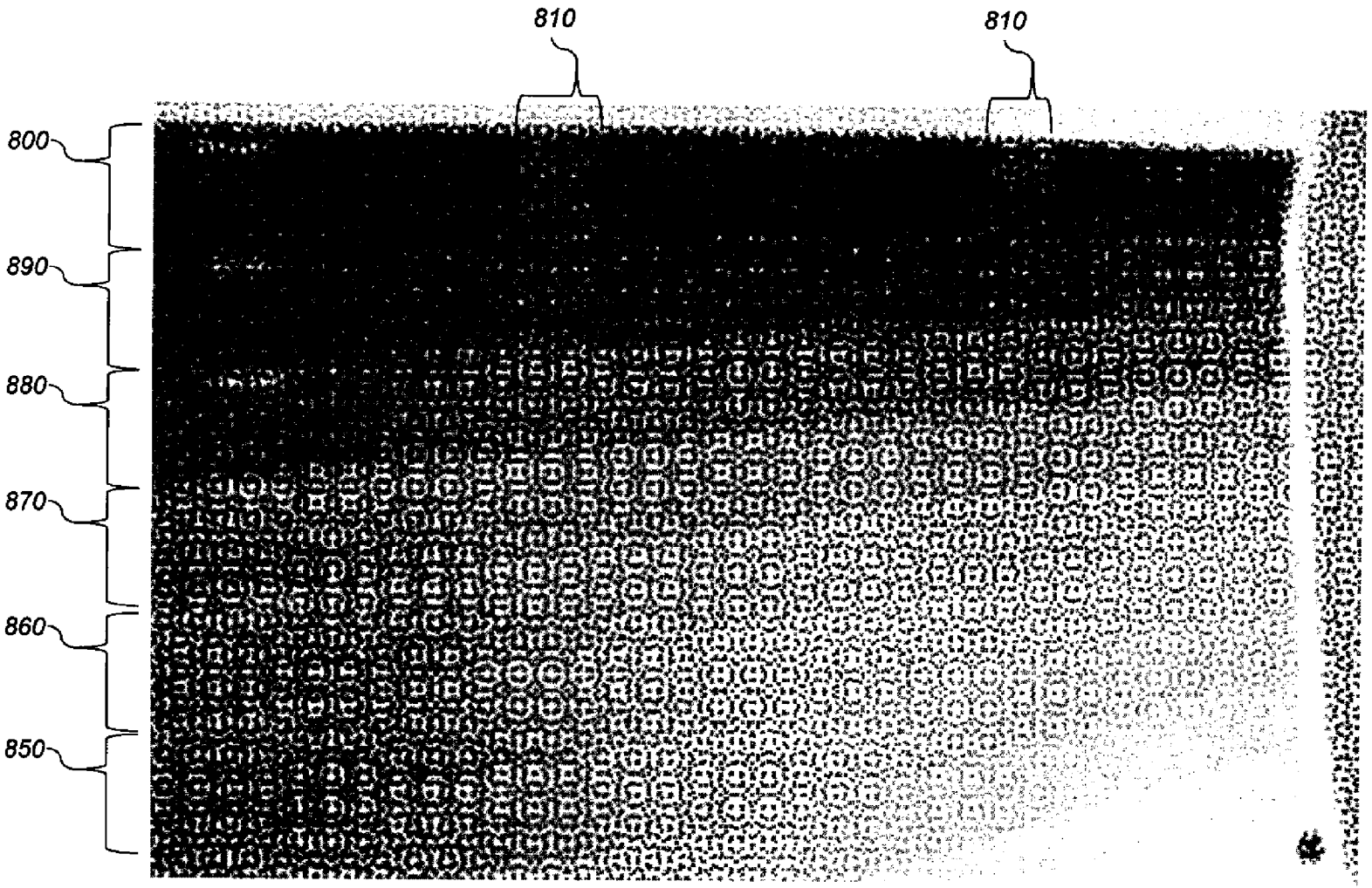
FIG. 8 shows a representation of a photograph of a printed test sample.

FIG. 8 shows a representation of a photograph of a printed test sample. The sample was printed on a KODAK PROSPER 5000XL printing press at 600×600 dpi without color management. No pre-coating was applied to the paper. A bypass path, as defined above, was used (no extender). A digital photograph of the print was taken. The photograph was then cropped and scaled, and Adobe Photoshop was used to prepare the figure from the cropped, scaled photograph. Contrast was applied to the RGB channels with a single control point at an input of 21 and an output of 46. This made offset regions 810 more visible.

The image was then converted to CMYK, desaturated to monochrome, color halftoned with a radius of 4 (image size 657×442), desaturated again, converted back to RGB, color-balanced to neutral, scaled to 774×521, and cropped to 774×496.

The test target was a series of bars of successively higher densities, printed with the cyan and magenta channels. Bars 850, 860, 870, 880, 890, 800 have densities of 50% CM, 60% CM, 70% CM, 80% CM, 90% CM, and 100% CM, respectively. "x % CM" signifies x % laydown of cyan and x % laydown of magenta. The output print was intended to be without defects, i.e., uniform, along each bar. However, some of the ink printed on the test target did not dry sufficiently before coming into contact with the first rotatable member (member 466, FIG. 4) touching the wet (last-inked) side of the receiver. Some of the still-wet ink adhered to the rotatable member and was pulled off the receiver. This phenomenon is referred to as roller offset or nip offset, depending on whether the receiver is passing around a single roller or through a nip when the offset occurs. As shown in FIG. 8, ink was removed from the receiver by offsetting in offset regions 810.

In an example, in regions of the receiver with a moisture content of at least 20% (e.g., by weight), ink can offset onto a roller ("roller offset"). In regions of the receiver with a moisture content of 10-20%, ink does not come off the receiver under light touch or a roller, but does come off under nip pressure ("nip offset"). In regions of the receiver with a moisture content below 10%, ink can stay on the paper even when passing through a nip. Paper generally has a moisture content around 5%, depending on environmental and storage conditions.

Figure 9:
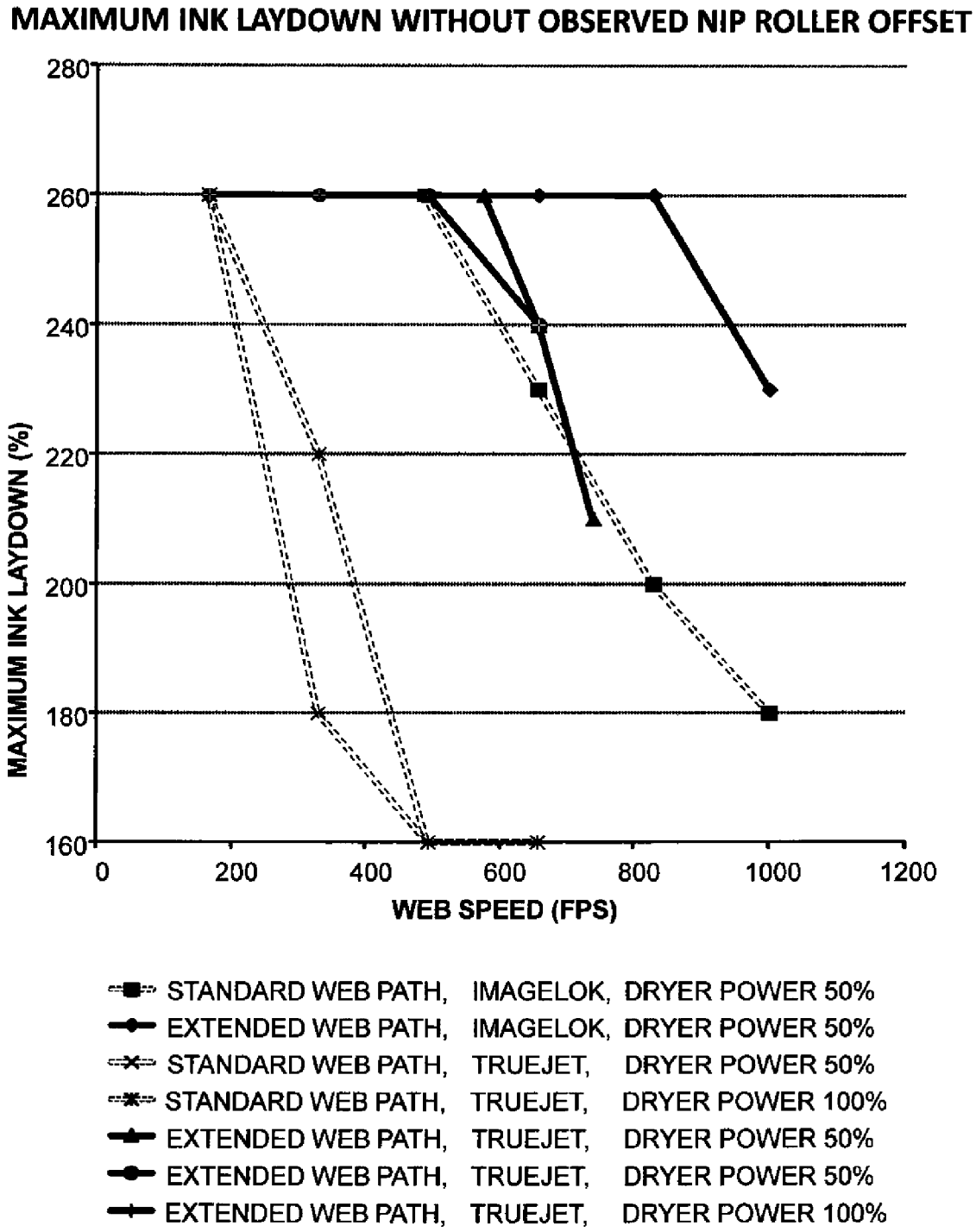
FIG. 9 shows offset data for various types of paper receiver at various speeds.

FIG. 9 shows offset data for various types of paper receiver at various speeds. Test targets were printed as discussed above with respect to FIG. 8. The abscissa shows the web speed in feet per second. The ordinate shows the maximum ink laydown, in percent, at which no nip offset was observed. This laydown is for a process black (C+M+Y+K) strip. The highest laydown tested was 260%. Tests were printed on INTERNATIONAL PAPER 24 lb. Bond paper with IMAGELOK at web speeds up to 1000 fpm, and on NEWPAGE TRUEJET 80 lb. Text paper at web speeds up to 738 fpm. Tests without a media-path extender are shown dashed; tests with an extender are shown solid.

As shown in FIG. 1, the press has three dryers 120: one after marking unit 170M, one after marking unit 170Y, and one after marking unit 170K. Each dryer draws up to 40 kW. Tests were performed with all three dryers operating at 50% power (20 kW), and with all three dryers operating at 100% power (40 kW).

For a given ink laydown, the extended web path permitted printing at higher speeds without offset. In this test, adding the media-path extender increased the maximum web speed for printing 260% coverage on Imagelok 24 lb. paper with no offset from 492 fpm to 828 fpm. On TrueJet 80 lb. paper, the maximum web speed with no offset increased from 164 fpm to 574 fpm when the extender was added. This improvement in performance permits the press operator to trade off print speed, ink coverage (print density), and paper type to achieve a print that will satisfy a customer.

Figure 5:
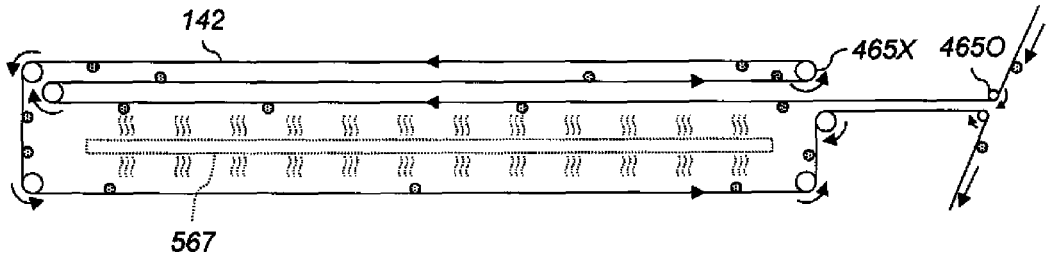
FIGS. 5-7 are elevational cross-sections of media paths in the printer shown in FIG. 4 according to various embodiments.
Figure 6:
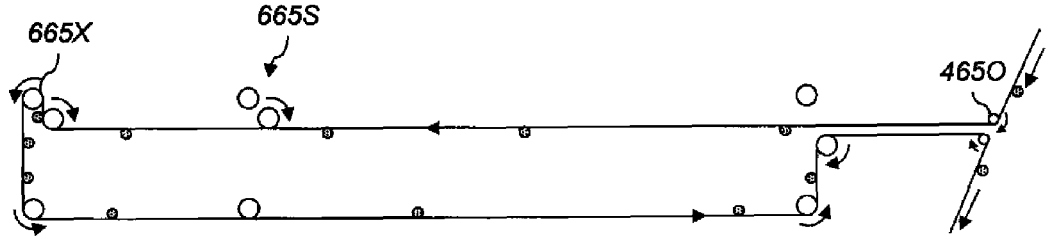
Figure 7:
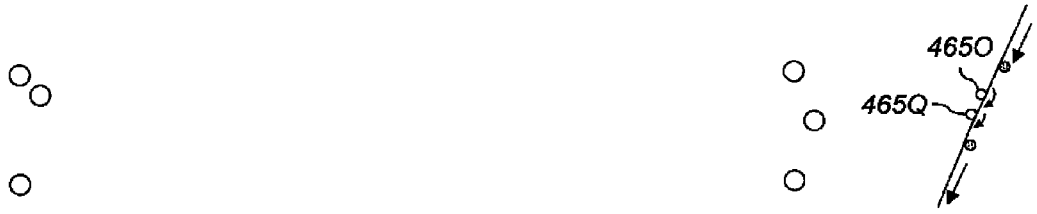

FIGS. 5-7 are elevational cross-sections of media paths through media-path extender 460 (FIG. 4). Small circles on receiver 142 graphically represent ink drops on the wet (most-recently-inked) side of receiver 142. FIG. 5 shows the path shown in FIG. 4, referred to herein as a "full path." FIG. 6 shows the same configuration of rotatable members as FIG. 4, but with the web threaded differently so not as much of the web is in extender 460. This is referred to herein as a "half path." FIG. 7 shows a "bypass path" in which the web is not threaded through extender 460, so passes members 465O, 465Q. As the amount of web in extender 460 increases, the media can cool more before exiting tower 401 (FIG. 4), improving performance. However, higher-amount configurations require more operator time to thread the web through, and can result in more waste at the beginning or end of a print job. The configuration of extender 460 to be used can be selected for each job, print run, or period of continuous printing.

Specifically, in various embodiments extender 460 further includes a second wet-side member (e.g., member 665X, FIG. 6) arranged to define an alternative extension media path. The first point of contact with the inked side is farther downstream in the alternative extension media path than in the extension media path, or vice versa. In various embodiments, the second wet-side member (e.g., member 665X, FIG. 6) is not as far downstream of dry-side member 465O in the alternative extension media path as in the extension media path. For example, FIG. 5 shows embodiments in which the first point of contact with the inked side is at member 465X. FIG. 6 shows other embodiments in which the first point of contact with the inked side is at member 665X, which is not as far downstream (along the media path) from member 465O as member 465X (FIG. 5) is from member 465O. Extender 460 can also include a plurality of rotatable members participating in any given media path, and can define more than one alternative extension media path. Any given rotatable member can participate in more than one media path. The printer is adapted to selectively transport the media along the bypass media path, the extension media path, or the alternative extension media path. The operator can select a media path by threading the media a certain way, or a controller can automatically select the media path depending on factors listed herein.

FIG. 6 also shows an example in which additional rotatable members 665S are provided that permit the web to be threaded as shown in FIG. 5 or 6, but shorter. In an example, member 465O is spaced apart horizontally from member 665X by approximately 3 m.

In various embodiments, rotatable members 465A, 465B, 465D, 465O, 465X (FIG. 4) are arranged to be separated as widely as possible for a given printer configuration. The longer the span between members, the more variation in Young's modulus of receiver 142 will be integrated over a long distance. This can provide more stable tension control.

FIG. 5 also shows embodiments in which extender 460 includes dryer 567 arranged to dry receiver 142. In the example shown, dryer 567 heats the most-recently-printed side of receiver 142 both before it reaches member 465X and after. In various embodiments, heat is concentrated on portions of receiver 142 before member 465X.

Figure 11:
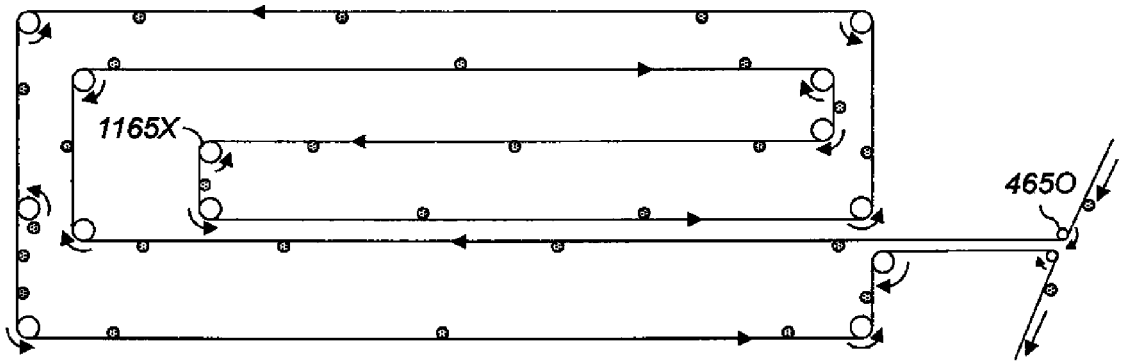
FIG. 11 is an elevational cross-section of a media path in the printer shown in FIG. 4 according to various embodiments.

FIG. 11 shows another media path according to various embodiments. Member 465O is as shown in FIG. 4. The first wet-side contact is rotatable member 1165X, which is farther downstream than member 465X (FIG. 4).

Figure 10:
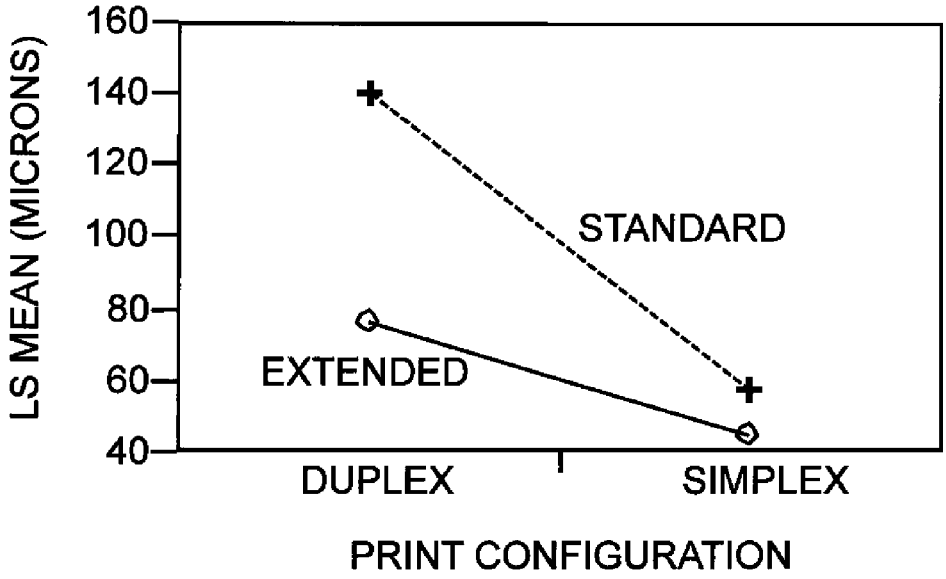
FIG. 10 shows results of a test that was performed of an extender.

FIG. 10 shows results of a test that was performed of an extender similar to extender 460 (FIG. 4) installed in the first tower of a two-tower printer. A turn bar was used as inverter 496 (FIG. 4). Simplex (printing using only tower 402, FIG. 4) and duplex (printing using towers 401 and 402, both FIG. 4) prints were made on a web at 100 fpm. The cross-track web movement was measured in each case. FIG. 10 shows simplex and duplex print configurations along the abscissa, with a trace for a standard web path (dashed; marked with crosses) and the extended web path (solid; marked with circles). The ordinate is the least-squares mean of the measured variation in cross-track web position, in microns (μm). As shown, duplex printing exhibits more variation in cross-track position than simplex printing. This is because printing on the first side distorts the paper used in the test, with distortion increasing as more ink is deposited per unit area of the paper. Registration is based on one edge of the paper and one mark printed on the first side, so variations in paper size due to moisture content affect the registration references. However, with the extended web path, both simplex and duplex showed reduced cross-track variation. This is an unexpected advantage of the extended web path over other ways of drying, such as adding additional dryers. The span between rollers in the extended web path provides gentle drying time that permits the paper to move towards its dry dimensions. Prior solutions to some of the other problems solved by various embodiments, such as excessive web heat, do not provide this advantage. For example, a conventional three-cooled-roller chiller placed between towers cools the web but does not permit it to dry to resume its relaxed dimensions. Conventional chillers have very short spans between the chiller roller, so there is not enough room between the rollers to attenuate web variation. The extender particularly adds to the web-handling system additional robustness against variations resulting from variations in the data printed in the first tower.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

20 continuous printing system
22 image source
24 image processing unit
26 mechanism control circuits
28 drop forming device

30 printhead
32 recording medium
34 recording medium transport system
36 recording medium transport control system
38 micro-controller
40 reservoir
42 catcher
44 recycling unit
46 pressure regulator
47 ink manifold
48 jetting module
49 nozzle plate
50 plurality of nozzles
51 heater
52 filament
54 small drops
56 large drops
57 trajectory
58 drop stream
60 gas flow deflection mechanism
62 gas flow
64 deflection zone
66 small drop trajectory
68 large drop trajectory
100 printer
101 tower
120 dryer
130 receiver transport system
142 receiver
155 camera
170C, 170M, 170Y, 170K marking unit
171 printing station
400 printer
401, 402 tower
441 dry side
443 wet side
450 scanner
460 media-path extender
465A, 465B, 465D rotatable member
465O, 465Q, 465X rotatable member
466 rotatable member
470C, 470M marking unit
472 printing station
496 inverter
567 dryer
665S rotatable members
665X rotatable member
810 offset region
800, 850, 860, 870, 880, 890 test bar
810 offset region
1165 rotatable member

The invention claimed is:

1. Apparatus for drying media having first and second sides and moving along a media path in a printer, comprising:

a) first and second printing stations arranged successively along the media path, adapted to selectively deposit ink on a first selected one of the sides and a second selected one of the sides of the media, respectively;

b) a dryer arranged along the media path downstream of the first printing station and upstream of the second printing station to dry the ink deposited on the first selected one of the sides of the media;

c) a first rotatable member around which the media path passes, so that the first selected one of the sides of the media contacts the first rotatable member while the media passes from the first printing station to the second printing station, and a bypass media path is defined from the first printing station past the first rotatable member to the second printing station; and d) a media-path extender arranged along the media path between the first printing station and the first rotatable member, downstream of the dryer, the media-path extender including a dry-side rotatable member and a wet-side rotatable member around which the media path passes, the dry-side and the wet-side rotatable members arranged so that the side other than the selected first of the sides contacts the dry-side rotatable member downstream of the first printing station, and the selected first of the sides contacts the wet-side rotatable member downstream of the dry-side rotatable member, the contact of the wet-side rotatable member to the first selected one of the sides of the media being the first point of contact with the first selected one of the sides of the media downstream of the first print station, so that an extension media path is defined from the first printing station past the dry-side rotatable member, the wet-side rotatable member, and the first rotatable member, in that order, to the second printing station;

e) wherein the printer is adapted to selectively transport the media either along the bypass media path or along the extension media path, and the distance along the extension media path from the first printing station to the wet-side rotatable member is longer than the distance along the bypass media path from the first printing station to the first rotatable member.

2. The apparatus according to claim 1, wherein the printer is adapted to reduce a temperature of the media by 20° while the media passes along the extension media path from the first printing station to the second printing station.

3. The apparatus according to claim 1, wherein the printer is adapted to reduce the moisture content of the deposited ink while the media passes along the extension media path from the first printing station to the wet-side rotatable member.

4. The apparatus according to claim 1, wherein the media-path extender further includes one or more dry-side rotatable members arranged along the media path upstream of the wet-side rotatable member.

5. The apparatus according to claim 1, wherein the media-path extender further includes a second wet-side member arranged to define an alternative extension media path, and the second wet-side member is not as far downstream of the dry-side member in the alternative extension media path as in the extension media path, and the printer is adapted to selectively transport the media along the bypass media path, the extension media path, or the alternative extension media path.

6. The apparatus according to claim 1, wherein the first selected one of the sides is a front side of the media and the second selected one of the sides is a back side of the media.

7. The apparatus according to claim 1, further including a respective chassis for each printing station, wherein the media-path extender is disposed under the chassis corresponding to the first printing station.

8. The apparatus according to claim 1, wherein the media is a web.

9. The apparatus according to claim 8, wherein the media web is self-supported.

10. The apparatus according to claim 1, wherein the media are cut sheets, the apparatus further including one or more rotatable transport members arranged along the media path to carry the media sheets.

* * * * *